United States Patent [19]

Schwanz

[11] 4,170,863

[45] Oct. 16, 1979

[54] APPARATUS FOR THE CONTINUOUS PRODUCTION OF PACKAGES

[75] Inventor: Hugo Schwanz, Rielasingen, Fed. Rep. of Germany

[73] Assignee: Sig Schweizerische Industriegesellschaft, Neuhausen am Rheinfall, Switzerland

[21] Appl. No.: 874,357

[22] Filed: Feb. 1, 1978

[30] Foreign Application Priority Data

Feb. 2, 1977 [CH] Switzerland ..... 1249/77

[51] Int. Cl.[2] ..... B65B 31/06

[52] U.S. Cl. ..... 53/511; 53/229

[58] Field of Search ..... 53/112 A, 22 A, 229

[56] References Cited

U.S. PATENT DOCUMENTS

| | | | |
|---|---|---|---|
| 3,009,298 | 11/1961 | Gerlacld et al. | 53/112 A X |
| 3,210,905 | 10/1965 | Gerlacld | 53/112 A |
| 3,274,746 | 9/1966 | James et al. | 53/22 A |
| 3,701,229 | 10/1972 | Zelnick | 53/112 A X |

*Primary Examiner*—Travis S. McGehee

*Attorney, Agent, or Firm*—Spencer & Kaye

[57] ABSTRACT

In apparatus for packaging objects by enclosing them in a tube of packaging material, which tube presents two projecting longitudinal flaps which are subsequently welded together to form a longitudinal seam, a flat nozzle is inserted between the flaps ahead of the longitudinal seam welding location and is connected to a suction source for extracting air from each package being formed.

9 Claims, 5 Drawing Figures

APPARATUS FOR THE CONTINUOUS PRODUCTION OF PACKAGES

BACKGROUND OF THE INVENTION

The present invention relates to an apparatus for the continuous production of packages of the type including a conveying device which feeds in the individual objects or groups of objects to be packaged, a folding box which shapes the packaging material supplied in an endless form into a tube which encloses the objects or groups of objects and which has two protruding contacting flaps, a conveying unit for advancing the tube, welding members to produce a longitudinal seam of the package at the flaps, and welding and cutting devices to produce the transverse seam and sever the individual packages.

Devices of this type are known. During the manufacture of packages by means of such a device, the transverse seam is produced by pressing the tube and welding it by means of heated jaws of an appropriate pair of rollers in the region between two objects or groups of objects. This causes the air present in the tube cavity to escape.

In the packaging of certain types of products, this air can easily escape toward the rear between the tube and the objects. But if the objects to be packaged rest flush against the interior of the tube or adhere thereto, be it due to their consistency or as a result of electrostatic charges in the foil material of the tube, the escape of air is impeded. As a result, the finished packages have excess interior pressure and are consequently puffed up. This may lead to excess stresses on the welded seams and faulty folding. Furthermore, puffed-up packages are not well suited for further processing into larger packages.

SUMMARY OF THE INVENTION

It is therefore an object of the present invention to provide an apparatus of the above-mentioned type which reliably prevents the occurrence of excess pressure in the finished packages.

The apparatus according to the invention achieves this object by the provision, following the folding box between at least one unheated pair of guide rollers for the protruding flaps and a first heated pair of welding rollers for producing the longitudinal seam, of a flat nozzle at the flaps, the flat nozzle extending in the longitudinal direction of the tube and having an opening which engages between the two flaps, this flat nozzle being connected with the suction end of a vacuum pump.

This system assures that a major portion of the air present in the cavities of the tube will be extracted before the transverse seam is formed so that it no longer need be pressed out by the transverse welding jaws. This produces not only the advantage that the finished packages no longer have any excess pressure, but also offers the possibility of increased production since the advance of the tube by means of the transverse welding members can occur faster if there is no air, or at least less air, to be displaced.

Furthermore, the difference in pressure between the external atmosphere and the subatmospheric pressure in the tube presses the packaging material inwardly so that the objects or groups of objects in the packaging tube are more securely positioned.

It is known to equip apparatuses of the above-mentioned type with a device which permits the introduction of a gas into the tube so as to form a protective atmosphere in the closed packages. This is advisable if certain items of food, such as cheese or cookies, for example, are to be packaged. The gas flow speeds created in the known devices are so great, due to the small tube cross section, that loose crumbs are carried along, impeding the operational dependability of the apparatus.

The apparatus according to the invention also results in an improvement in the production of such gas-filled packages. According to a preferred embodiment of the invention, a further flat nozzle may be provided in front of and/or behind behing the first flat nozzle, when seen in the conveying direction of the tube, the further flat nozzle engaging between the flaps. This permits the simultaneous extraction of air and addition of gas, making it possible to produce a more concentrated protective atmosphere.

DESCRIPTION OF THE PREFERRED EMBODIMENTS

Figure 1:
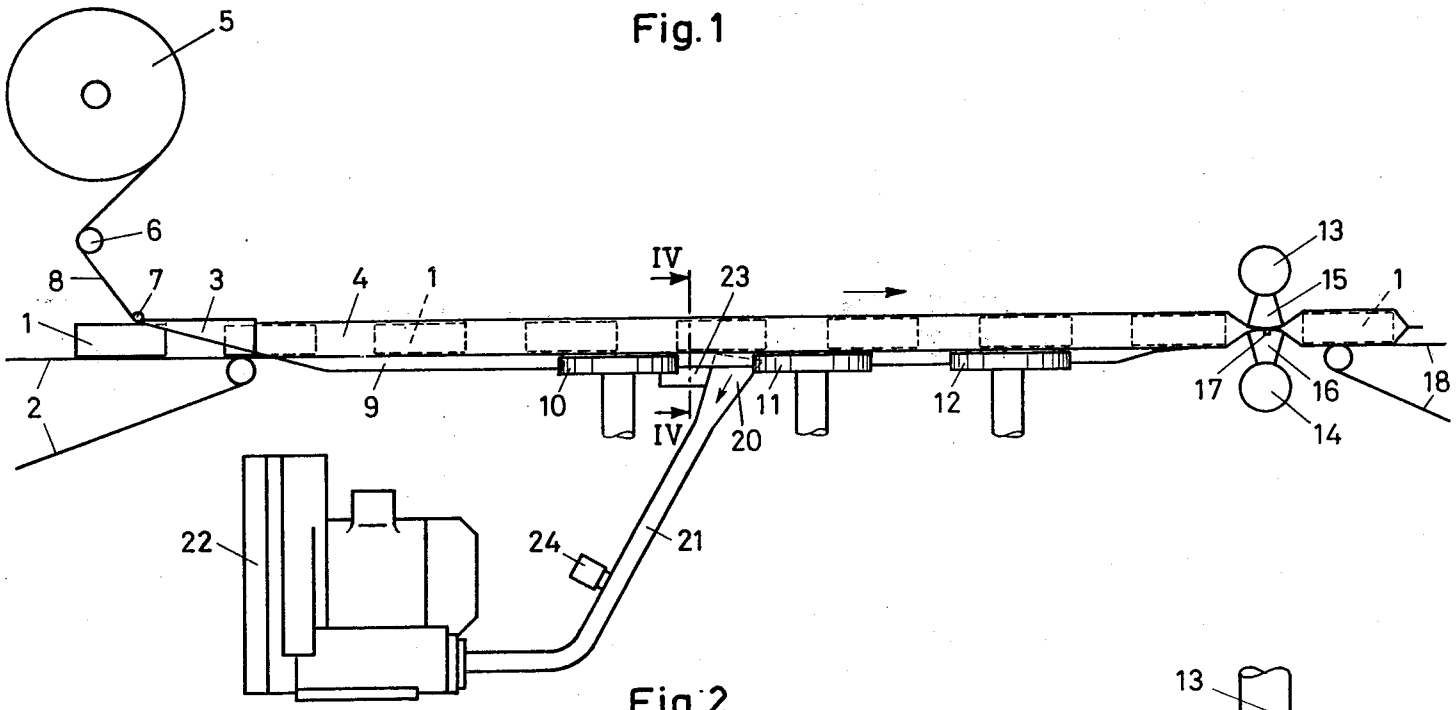
FIG. 1 is a simplified side elevational view of a preferred embodiment of the apparatus according to the invention for the continuous production of packages.
Figure 2:
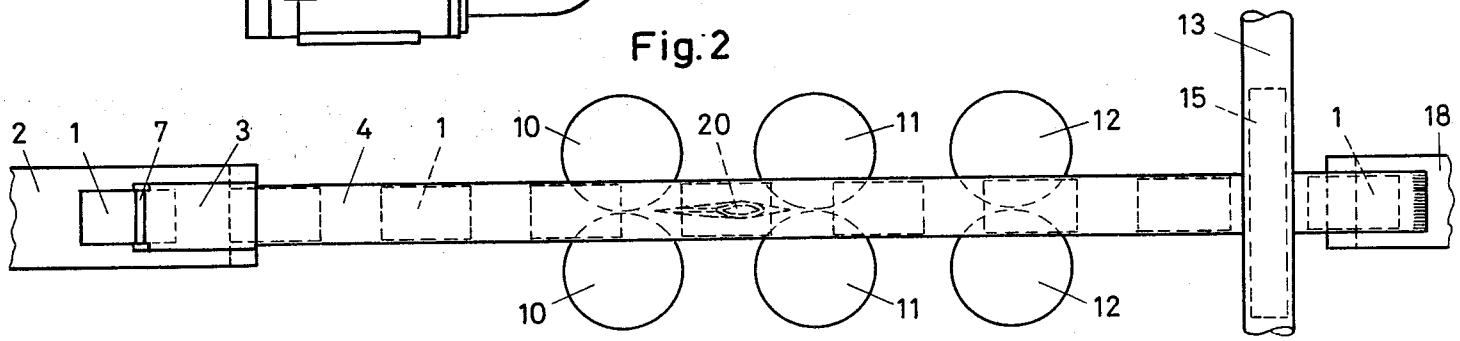
FIG. 2 is a plan view of the device of FIG. 1 with the supply roll of packaging material and the vacuum pump omitted.

In the apparatus shown in FIGS. 1 and 2, objects 1 to be packaged are introduced at uniform, or equally spaced, intervals onto a conveying device which is constituted by an endless conveyor belt 2 and are pushed into a folding box 3 in which the packaging tube 4 is formed. The folding box 3 is supplied with packaging material 8 from a supply roll 5 via guide rollers 6 and 7. The packaging material 8 is preferably paper or cellophane with a coating of a thermoplastic, weldable material. A foil of thermoplastic material could also be used.

In the folding box 3, the packaging material is placed, in a known manner, in the form of a tube around the objects to be packaged, protruding flaps 9 being produced on the underside. These flaps are gripped by driven pairs of rollers 10, 11 and 12 and the tube is thus transported along its conveying path. The pair of rollers 11 is heated, for example electrically, and during the passage of the packaging material it welds the flaps 9 together to form a longitudinal seam.

The tube 4 with the objects 1 enclosed therein then enters a device for producing the transverse seam. This device includes two rollers 13 and 14 carrying two segment-shaped heated jaws 15 and 16. The rollers 13 and 14 are driven by the machine in synchronism so that the two jaws 15 and 16 periodically press the tube 4 together and weld it, always at a location midway between two succeeding objects 1. The jaw 15 is further provided with a blade 17, which moves against a counterpart of jaw 16 and severs the transverse weld seam. The packaged objects 1 are then transported on to further processing apparatus by a conveyor belt 18. The blade 17 could of course also be disposed at a further pair of rollers having jaws.

The above-described parts of the packaging device are known per se.

The pair of rollers 10 is not heated and serves as a pair of guide rollers for guiding the two flaps 9 which protrude downwardly from the tube 4. Between the pair of guide rollers 10 and the heated pair of welding rollers 11 a flat nozzle 20 protrudes from below between the two flaps 9. The flat nozzle 20 is connected with a known vacuum pump 22 via a pipeline 21.

Figure 3:
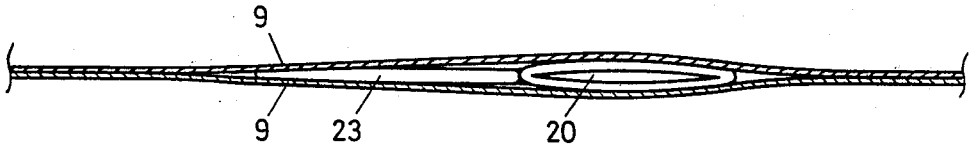
FIG. 3 is a top plan view to an enlarged scale, of the aperture of the flat nozzle of FIGS. 1 and 2.
Figure 4:
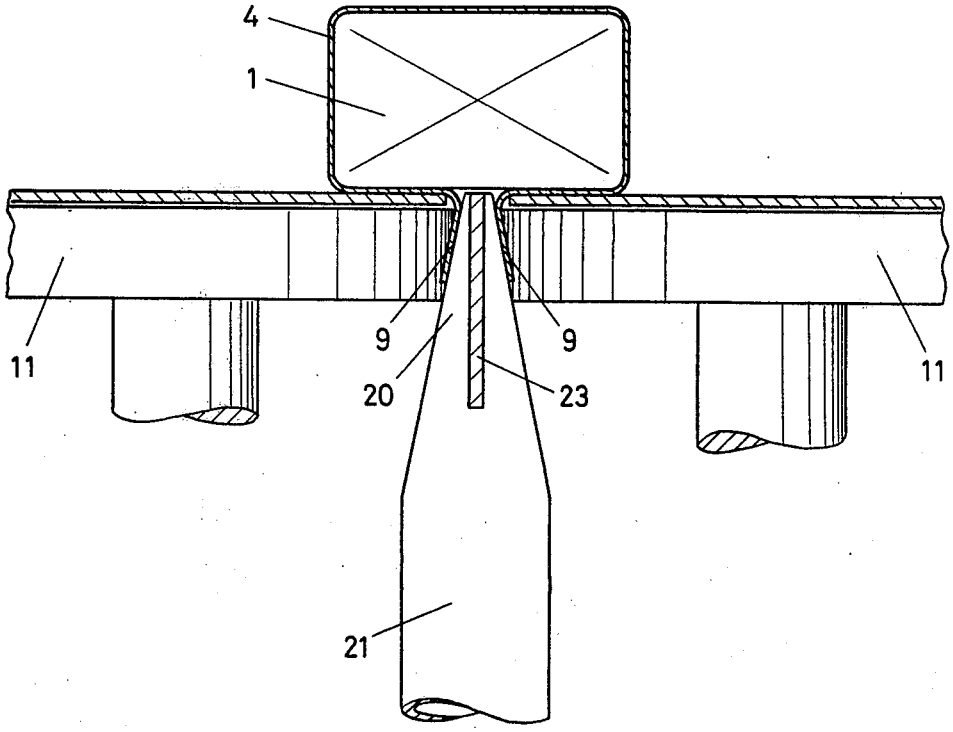
FIG. 4 is a cross-sectional detail view along the line IV—IV of FIG. 1, to an enlarged scale.

The flat nozzle 20 has an opening with a lenticular cross section, as shown most clearly in FIG. 3. It is connected to a guide plate 23 having a wedge-shaped cross section in the plane of FIG. 3, i.e. plate 23 is tapered in the direction opposite to that of tube advance, so that the two flaps 9 are spread out in as gentle and unimpeded a way as possible. The outlet opening of the flat nozzle 20 is inclined in the direction of tube advance toward the bottom of the tube 4, and is thus spaced in part from the bottoms of the passing objects 1. This assures that the flat nozzle will not be periodically blocked by the passing objects, which might lead to undesirable vibrations in the suction line. The flat nozzle 20 and its pipeline 21 form an acute angle with the conveying direction of the tube 4.

The suction effect of the flat nozzle 20 can be influenced either by a change in the operating speed of the pump 22 or by means of a regulating device 24 in pipeline 21. Device 24 can be used, for example, in a known manner to vary the cross section of an air entrance opening into the pipeline 21.

A major portion of the air present in the tube 4 between the objects 1 is extracted through the flat nozzle 20 which is connected to the vacuum pump 22 so that only a small amount of air need be displaced by jaws 15 and 16 during formation and welding of the transverse seam.

Figure 5:
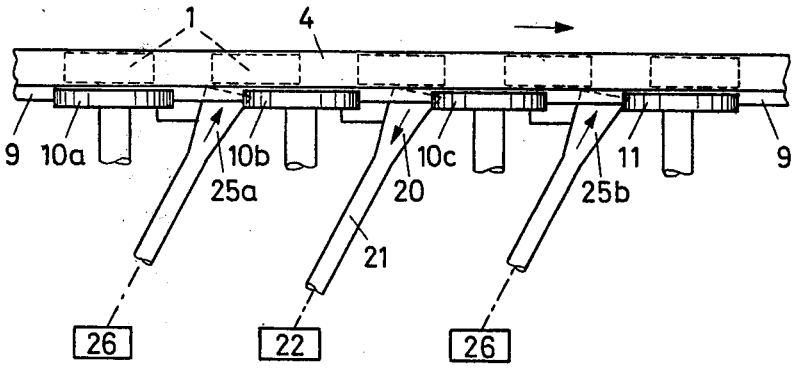
FIG. 5 is a schematic side elevational view of part of a modified embodiment of the apparatus of FIG. 1.

FIG. 5 is a schematic side view of a variation of the apparatus of FIG. 1. In this embodiment two flat nozzles 25*a* and 25*b* are provided in addition to the flat nozzle 20 which is connected with vacuum pump 22. The additional flat nozzles 25*a* and 25*b* engage between the flaps 9 of tube 4 in the same manner as the flat nozzle 20. The flat nozzles 25*a* and 25*b* are connected with compressed gas sources 26. In this way it is possible to produce, in a known manner, a protective atmosphere in the packages. The type of gas employed depends of course on the type of objects 1 that are packaged.

Depending on the nature and quantity of gas introduced, it may be sufficient to provide only one flat nozzle 25*a* or 25*b*. The important thing is of course that the first heated pair of rollers 11 is disposed downstream from the last flat nozzle. All of the other pairs of rollers 10*a*, 10*b*, 10*c*, disposed upstream of rollers 11, are not heated and serve only as guide roller pairs.

It will be understood that the above description of the present invention is susceptible to various modifications, changes and adaptations, and the same are intended to be comprehended within the meaning and range of equivalents of the appended claims.

What is claimed is:

1. In apparatus for the continuous packaging of objects, including a conveying device which supplies the individual objects or groups of objects to be packaged, means supplying an endless band of packaging material, a folding box for shaping the endless band into a tube which encloses the objects or groups of objects and two contacting flaps which protrude from the tube, conveying means downstream of said box for advancing the tube, welding members for welding the flaps together to form a longitudinal seam, and welding and cutting devices for producing transverse seams in the tube to define individual packages, and for severing the individual packages from one another, the improvement wherein said conveying means comprise a pair of unheated guide rollers, said welding members comprise a pair of heated welding rollers, and said apparatus further comprises a flat nozzle extending in the longitudinal direction of the tube and disposed downstream of said folding box between said pair of guide rollers and said pair of welding rollers so that the outlet end of said flat nozzle engages between the two flaps; and a vacuum pump connected via its suction side to said flat nozzle.

2. An arrangement as defined in claim 1 wherein the outlet end of said flat nozzle has a lenticular cross section.

3. An arrangement as defined in claim 2 further comprising a guide plate fastened to said nozzle near the outlet end thereof and extending in the direction opposite to the tube conveying direction.

4. An arrangement as defined in claim 3 wherein said plate is tapered to decrease in thickness in the direction opposite to the tube conveying direction.

5. An arrangement as defined in claim 1 wherein at least part of the outlet end of said flat nozzle is spaced from the bottom of said tube.

6. An arrangement as defined in claim 1 wherein the longitudinal axis of said flat nozzle forms an acute angle with the conveying direction of said tube.

7. An arrangement as defined in claim 1 further comprising a regulating device for varying the suction pressure disposed between said flat nozzle and said vacuum pump.

8. An arrangement as defined in claim 7 wherein said regulating device presents an inlet opening with regulatable cross section.

9. An arrangement as defined in claim 1 further comprising a further flat nozzle spaced from said first recited flat nozzle along the length of said tube, said further flat nozzle engaging between the flaps of said tube, and a source of compressed gas connected to said further nozzle.

* * * * *